US006608988B2

(12) United States Patent
Conrow

(10) Patent No.: US 6,608,988 B2
(45) Date of Patent: Aug. 19, 2003

(54) CONSTANT INVERTER SPEED TIMING METHOD AND APPARATUS FOR DUPLEX SHEETS IN A TANDEM PRINTER

(75) Inventor: Brian R. Conrow, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 153 days.

(21) Appl. No.: 10/029,060

(22) Filed: Oct. 18, 2001

(65) Prior Publication Data

US 2003/0077095 A1 Apr. 24, 2003

(51) Int. Cl.[7] ..... G03G 15/00; G03G 15/22

(52) U.S. Cl. ..... 399/364; 399/306

(58) Field of Search ..... 399/297, 306, 399/364

(56) References Cited

U.S. PATENT DOCUMENTS

| | | | | |
|---|---|---|---|---|
| 5,130,750 A | * | 7/1992 | Rabb | 399/364 |
| 5,467,182 A | * | 11/1995 | Hower et al. | 399/364 |
| 5,598,257 A | * | 1/1997 | Keller et al. | 399/364 |
| 5,812,273 A | * | 9/1998 | Conley et al. | 399/364 X |
| 5,963,770 A | * | 10/1999 | Eakin | 399/364 |
| 5,970,295 A | * | 10/1999 | Samizo | 399/306 X |
| 6,064,848 A | * | 5/2000 | Haneda | 399/306 X |

* cited by examiner

*Primary Examiner*—Fred L. Braun
(74) *Attorney, Agent, or Firm*—Perman & Green, LLP

(57) ABSTRACT

The disclosed embodiments are directed to a method and apparatus for duplex imaging in a tandem print engine system. The features of the disclosed embodiments include imaging a first side of a sheet in a first marking module in the system, inverting the sheet, and imaging a second side of the sheet in a second marking module in the system one pitch after N revolutions of a photoreceptor following the first side imaging.

19 Claims, 4 Drawing Sheets

CONSTANT INVERTER SPEED TIMING METHOD AND APPARATUS FOR DUPLEX SHEETS IN A TANDEM PRINTER

BACKGROUND OF THE INVENTION

1. Field of the Invention

The present invention relates to document handling systems and, more particularly, to document handling in a duplex imaging system.

2. Brief Description of Related Developments

There have been various approaches in the duplicating and printing field for printing on a first side and a second side of a sheet.

A printing system adapted for use in high speed printing can employ two print engines arranged in tandem. In some instances, the print engines are arranged in straight-line tandem. Each print engine prints on one side of the sheet. In this way, duplex prints are formed. Each print engine may be an electrophotographic print engine. These print engines are generally identical to one another and have a photoconductive member that is charged to a substantial uniform potential so as to sensitize the surface thereof. The charged portion of the photoconductive member is exposed to a light image of a document being printed. Exposure of the charged photoconductive member effectively dissipates the charge thereon in the irradiated areas to record an electrostatic latent image on the photoconductive member corresponding to the informational areas desired to be printed. After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the photoconductive surface. After the electrostatic latent image is developed with the toner particles, the toner powder image is transferred to a sheet. Thereafter, the toner powder image is heated to permanently fuse it to the sheet. After the toner powder image has been formed on one side of the sheet, the sheet is advanced to the next print engine to have information printed on the other side thereof. The sheet may be inverted or the print engine may be oriented so as to print on the opposed side of the sheet. In any event, both print engines are substantially identical to one another and produce a sheet having information on opposite sides thereof, i.e., a duplex sheet. This is duplex printing. While electrophotographic print engines may be utilized, one skilled in the art will appreciate that any other type of print engine may also be used. For example, ink jet print engines, or lithographic print engines may be used. Furthermore, these print engines may be mixed and matched. Thus, the printing system does not necessarily require only electrophotographic print engines or only ink jet print engines or only lithographic print engines, but rather may have an electrophotographic print engine and an ink jet print engine, or any such combination. Another approach has been to provide a sheet handling mechanism for inverting a sheet within one print engine so as to form duplex prints as an output therefrom. Such machines are more compact than the tandem arrangement.

The following disclosures appear to be relevant to printing system using tandem print engines: U.S. Pat. No. 5,568,246; Patentee: Keller, et al.; Issued: Oct. 22, 1996; U.S. Pat. No. 5,598,257; Patentee: Keller, et al.; Issued: Jan. 28, 1997; U.S. Pat. No. 5,730,535; Patentee: Keller, et al.; Issued: Mar. 24, 1998.

The references cited, U.S. Pat. Nos. 5,568,246, 5,598,257; and 5,730,535, disclose a printing system including two print engines arranged in tandem. Each print engine includes an inverter. The print engines are electrophotographic printing machines.

In the description herein the term "sheet" generally refers to a usually flimsy physical sheet of paper, plastic, or other suitable physical substrate for images, whether precut or web fed. A "copy sheet" may be abbreviated as a "copy". A "job" is normally a set of related sheets, usually a collated copy set copied from a set of original document sheets or electronic document page images, from a particular user, or otherwise related. Simplex documents have images on only one side and a duplex document has images on both sides.

SUMMARY OF THE DISCLOSED EMBODIMENT(S)

In a first aspect, the disclosed embodiments are directed to a method of duplex imaging in a tandem print engine system. The features of the disclosed embodiments include imaging a first side of a sheet in a first marking module in the system, inverting the sheet, and imaging a second side of the sheet in a second marking module in the system one pitch after N revolutions of a photoreceptor following the first side imaging.

In another aspect, the features of the disclosed embodiments are directed to a method of duplex imaging in a single print engine electrophotographic system. The method of this embodiment includes imaging a first side of a sheet, inverting the sheet, and imaging a duplex side of the sheet one pitch after an integer number of revolutions of a photoreceptor in the system.

In a further aspect, the features of the disclosed embodiments are directed to an electrographic printing system. The features of this embodiment include a tandem print engine system including a first photoreceptor and a second photoreceptor. The first and second photoreceptor each have seams that are offset by an amount X relative to each other. Each of the first and second photoreceptors are revolving at a constant speed wherein an imaging of a duplex side of a sheet occurs an (N+X) number of revolutions and one pitch after imaging of a simplex side of the sheet. N is an integer number of revolutions of the first and second photoreceptor and X is any real number.

In yet another aspect, the disclosed embodiments are directed to a computer program product. Features of this embodiment include a computer useable medium having computer readable code means embodied therein for causing a computer to perform duplex imaging in a tandem print engine system. The computer readable code means in the computer program product comprise computer readable program code means for causing a computer to image a first side of a sheet in a first marking module in the system, computer readable program code means for causing a computer to invert the sheet, and computer readable program code means for causing a computer to image a second side of the sheet in a second marking module in the system one pitch after N revolutions of a photoreceptor following the first side imaging.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT(S)

Figure 1:
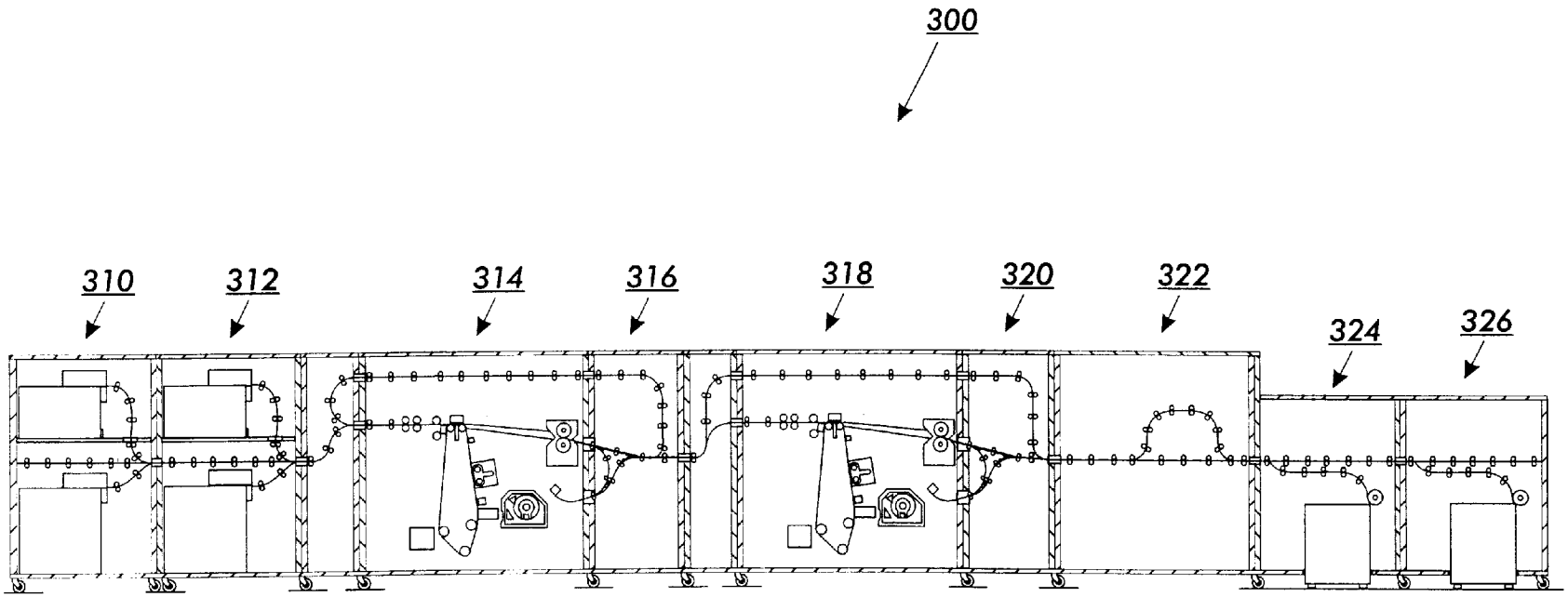
FIG. 1 is an elevational view illustrating schematically one embodiment of a tandem print system incorporating features of the present invention.

Referring to FIG. 1, there is shown a schematic view of a system 300 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The system shown in FIG. 1 generally comprises a tandem print system 300. The system 300 generally includes an inverter device 316 that is adapted to image a duplex side of a sheet one pitch after an integer or non-integer number of revolutions of a photoreceptor in the system 300. In one embodiment the system 300 can be a xerographic system generally comprising a feeder 310, a second feeder 312, a marker 314, an inverter 316, a second marker 318, a second inverter 320, a decurler/output converter 322 a stacker 324 and a second stacker 326. In an alternate embodiment, the system 300 could include other than the xerographic system and include suitable components for a tandem print system. It is a feature of the present invention to enable a constant inverter speed for all pitch modes.

Figure 2:
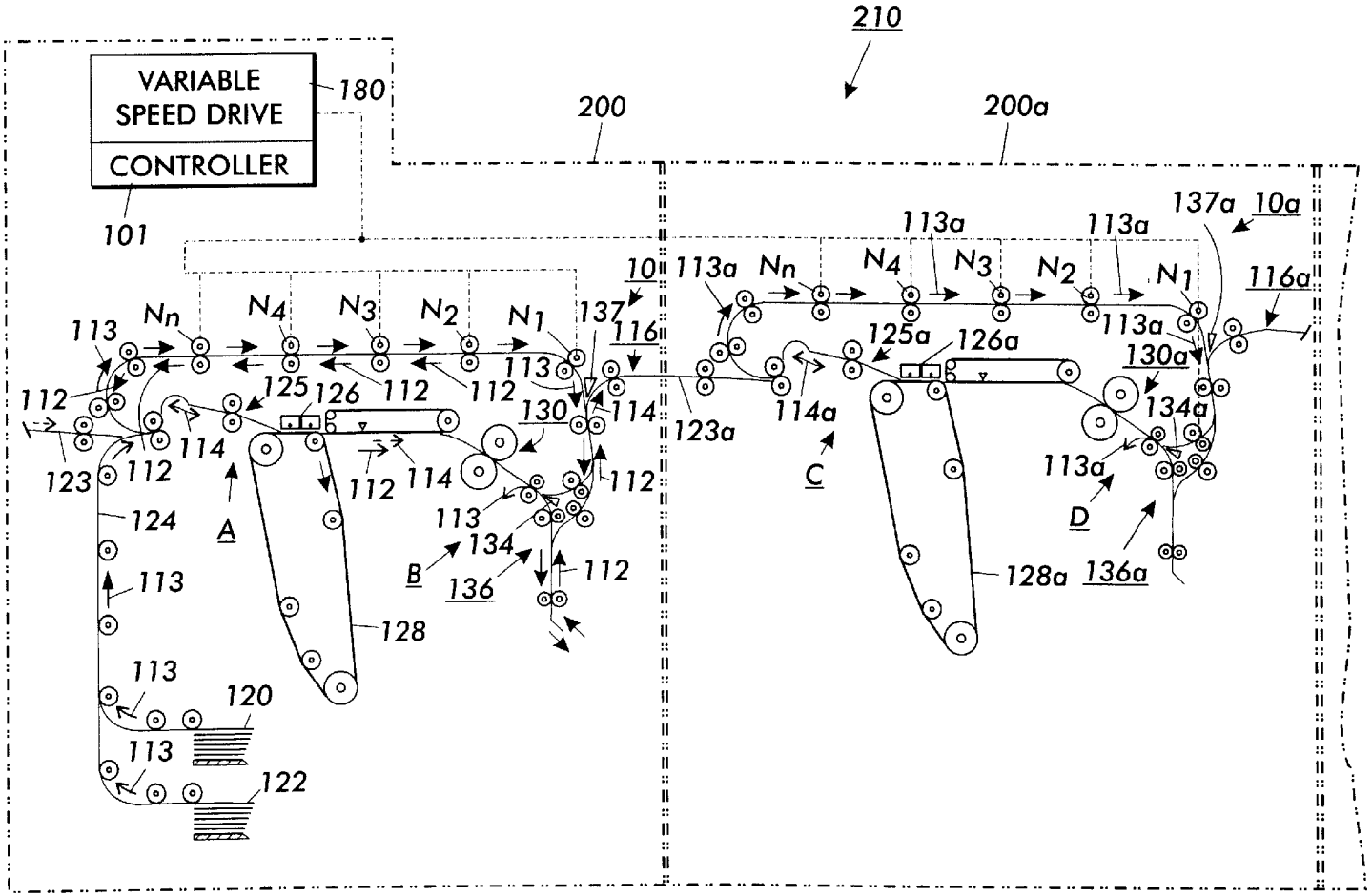
FIG. 2 is an elevational view illustrating schematically an embodiment of a tandem print system incorporating features of the present invention.

Referring to FIG. 2, another embodiment of a tandem print system 210 is illustrated. In a tandem machine or system 210, as shown in FIG. 2, the simplex side of a sheet is imaged in a first marking module 200 and the second side of the sheet is imaged in the second marking module 200*a* after inversion. In FIG. 2, the first marking module 210 comprises a duplex laser printer 10 shown by way of example as an automatic electrostatographic reproducing machine. Although the present invention is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed system.

In FIG. 2, the photoreceptor is 128, the clean sheets 110 are in paper trays 120 and 122 (with an optional high capacity input path 123), the vertical sheet input transport is 124, transfer is at 126, fusing at 130, inverting at 136 selected by gate 134. There is an overhead duplex loop path 112 with plural variable speed feeders $N_1$-$N_n$ providing the majority of the duplex path 112 length and providing the duplex path sheet feeding nips; all driven by a variable speed drive 180 controlled by the controller 101. This is a top transfer (face down) system. An additional gate 137 selects between output 116 and dedicated duplex return loop 112 here.

As shown in FIG. 2, the endless loop duplex (second side) paper path 112 through which a sheet travels during duplex imaging is illustrated by the arrowed solid lines, whereas the simplex path 114 through which a sheet to be simplexed is imaged is illustrated by the arrowed broken lines. Note, however, that the output path 116 and certain other parts of the duplex path 112 are shared by both duplex sheets and simplex sheets, as will be described. These paths are also shown with dashed-line arrows, as are the common input or "clean" sheet paths from the paper trays 120 or 122.

After a "clean" sheet is supplied from one of the regular paper feed trays 120 or 122 in FIG. 2, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to a finisher or stacker, or if the sheet is being duplexed, the gate 134 will be positioned by sensor 132 (led emitter and receiver) and controller 101 to deflect that sheet into the inverter 136 of the duplex loop path 112, where that sheet will be inverted and then fed to sheet transport 125 for recirculation back through transfer station 126 and fuser 130 for receiving and permanently fixing the side two image to the backside of that duplex sheet, before it exits via exit path 116.

The present invention enables a constant inverter speed for all pitch modes. Pitch refers to the number of image panels that occur within a revolution of the photoreceptor belt. It is based on the size of the photoreceptor (PR) belt and the size of the sheets being printed on. For example, 8.5" long sheets might be printed in "10 pitch mode" (10 prints per PR belt revolution) while much larger sheets (17" long) might be printed in some smaller pitch mode (e.g. "5 pitch mode"). Generally, the second side of the sheet, also referred to as the duplex sheet, is imaged one pitch after an integer number of photoreceptor 128 revolutions N following the simplex side imaging. This is also referred to herein as "N revolutions+1 pitch" or "N+1" duplex timing strategy. Generally, the inverter speed is set so that the time between the simplex transfer and the duplex transfer is equal to N+X+1 pitch. In a machine with one photoreceptor 128, the time between a start of the transfer of the simplex and duplex images would be equal to the time it takes for the photoreceptor to travel one complete revolution plus one pitch.

In a system 200 having only one photoreceptor belt 128 as shown in FIG. 2, two passes are required in order to image both sides of a duplex sheet. In accordance with features of the present invention, the photoreceptor 128 travels at a constant speed and the N+1 timing requires that N be an integer. Otherwise, the image frames for a pitch mode would not be aligned on successive belt 128 revolutions.

Referring to FIG. 2, in normal operation of the tandem print engines configuration a "clean" sheet is supplied from one of the regular paper feed trays 120 or 122, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows a simplex sheet to move directly via output 116 to bypass module 200*a* via path 113*a*, or deflects the sheet into the duplex path 114*a*. Duplex imaging at the sheet occurs in module 200*a*. The sheet is conveyed to registration transport 125*a* past image transfer station 126*a* to receive an image from photoreceptor 128*a*. The sheet then passes through the fuser 130*a* where the image is permanently fixed or fused to the sheet. After passing through the fuser, a gate 134*a* either allows the sheet to move directly via output 116*a* to a finisher or stacker. The sheet is conveyed via the bypass path

113*a* of module 200*a* to gate 134*a* whereupon the sheet will be positioned to deflect the sheet into the inverter 136*a* where that sheet will be inverted and then fed to the output 116*a* to a finisher or stacker.

Figure 3:
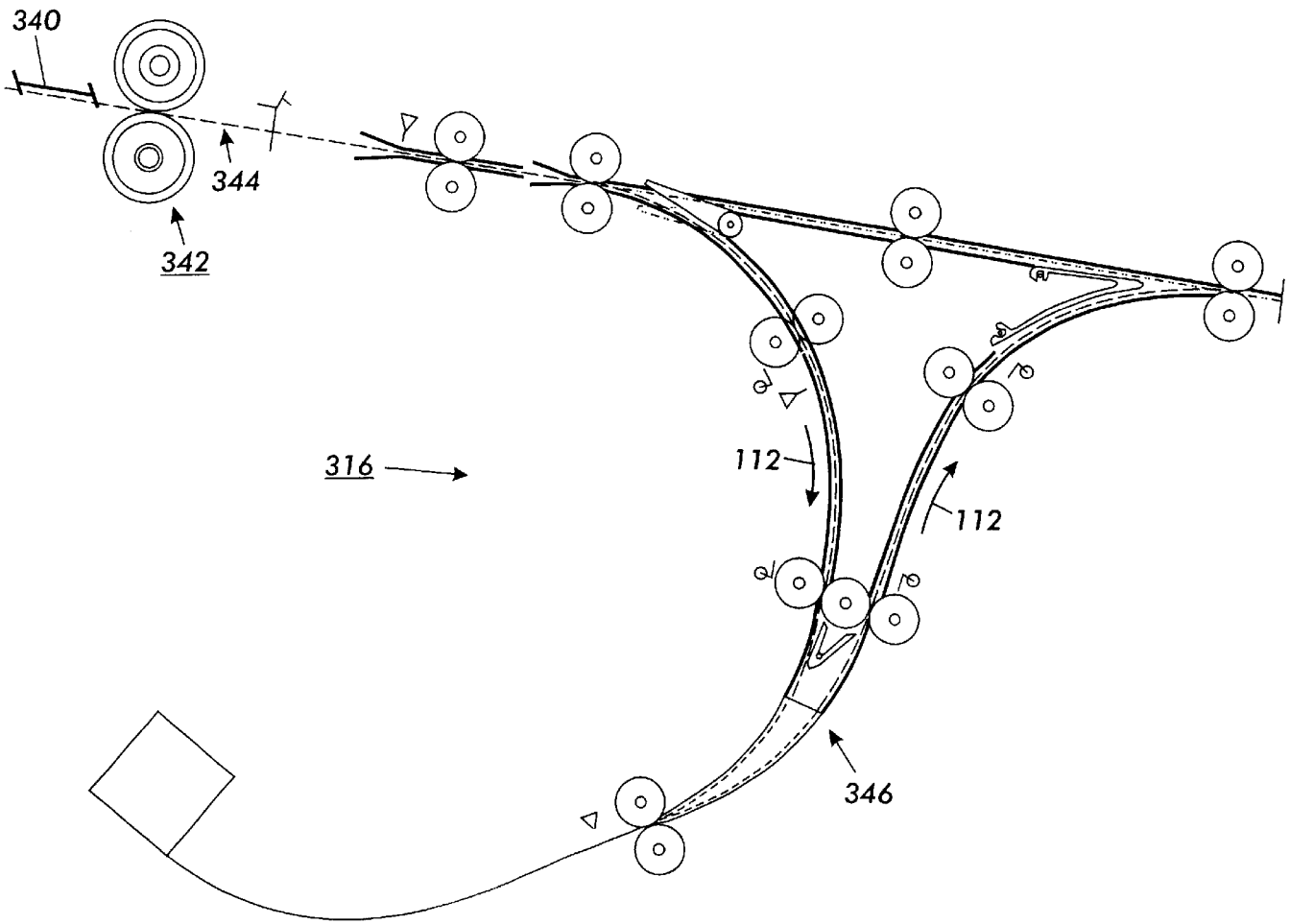
FIG. 3 is an exploded perspective view of the inverter of FIG. 1.

Referring to FIG. 3, an exploded view of the inverter 316 of FIG. 1 is shown. As shown in FIG. 3, in accordance with features of the present invention, as a sheet 340 passes through the fuser 342, the sheet 340 accelerates when the virtual trailing edge ("Virtual TE") of the sheet 340 reaches the output point in the paper path 112, defined as reference 344. The virtual trailing edge of a sheet can be defined as the trailing edge of the largest sheet in the given pitch mode. As the sheet 340 travels along the paper path 112 the inverter 316, the sheet 340 stops when the original trailing edge 350, actual, not virtual, of the sheet 340 reaches the point 346 in the path 112 where the direction of movement of the sheet changes, also referred to herein as the direction change point. In one embodiment, the direction of travel of the sheet 340 is changed, or reversed, when the original trailing edge 350 of the sheet 340 reaches the direction change point 346.

The tandem print engine system incorporating features of the present invention, enables constant inverter speed as in the "N revolutions+1 pitch" embodiment, but N does not need to be an integer. The non-integer portion of N can be equivalent to the amount of offset between the seam of photoreceptor 128 and the seam of photoreceptor 128*a*. The seam on the photoreceptor belt is an area that cannot be printed on. It is the area in which the two ends of the belt are joined to form a continuous loop. This offset enables the turning of the photoreceptor belts or inverter speed to be independent of the paper path length between transfer points. This can increase the flexibility in choosing inverter speeds that meet crash timing and registration constraints. Generally, referring to FIG. 2, in one embodiment a tandem engine system incorporating features of the present invention, the two photoreceptor belts 128 and 128*a* have seams that are offset by an amount X. The timing strategy can be equated to "(N+X)" revolutions+1 pitch", where N is still an integer but X can be any real number. The offset between the two photoreceptor seams assumes that belts 128 and 128*a* are of equal length. The inverter speed is set so that the time between the simplex transfer and the duplex transfer is equal to N+X+1 pitch. This allow for an imaging of a duplex side of a sheet to occur an (N+X) number of revolutions and one pitch after the imaging of a simplex side of the sheet.

In most cases, the "duplex loop" or paper path length between photoreceptor belts in a tandem engine is much shorter than an actual duplex loop in a single engine machine. Since the duplex path distance will typically be much shorter, the inverter speeds would need to be much higher to achieve "N+1" timing where N=1. There is no offset X in a single print engine. At the present time, such speeds are above the upper bound for the agile registration systems used today. In order to achieve N=2, the inverter speed would be too low to create a sufficient inter-copy gap in the inverter resulting in sheet crashes.

By realizing that this "(N+X)+1" timing strategy could work with offset photoreceptor belt seams, the optimal inverter speed for sheet crash avoidance and registration input can be selected by adjusting the offset. The duplex path length is no longer a constraint.

The following equations illustrate why this works:

Let:

IDZ=inter-document zone on the photoreceptor (mm)

L1=the maximum sheet size for pitch mode 1 (mm)

L1+IDZ=pitch size for pitch mode 1 (mm)

L2=the maximum sheet size for pitch mode 2 (mm) (L1>L2)

L2+IDZ=pitch size for pitch mode 2 (mm)

PR=photoreceptor length (mm)

Vp=process speed=photoreceptor speed (mm/sec)

Vi=inverter speed (mm/sec)

Assuming "(N+X)+1" timing:

(1) Transfer-to-transfer time between simplex and duplex images for pitch mode 1=[(N+X)*PL+L1+IDZ]/Vp (sec)

(2) Transfer-to-transfer time between simplex and duplex images for pitch mode 2=[(N+X)*PL+L2+IDZ]/Vp (sec)

(3) Difference in transfer-to-transfer time=(1)−(2)=(L1−L2)/Vp (sec)

Note: There is a greater delay before the duplex image for Pitch Mode 1 arrives at transfer.

Actual sheet time:

(4) Difference in times for virtual trail edge acceleration=(L1−L2)/Vp−(L1−L2)/Vi (sec)

Note: More time passes before sheet 1 is accelerated to the inverter speed.

(5) Difference in times for trail edge stop=(L1−L2)/Vi (sec)

Note: More time passes before sheet 1 comes to a stop.

There are no other areas where the sheet timing differs.

(6) Total difference in transfer-to-transfer timing of sheets=(4)+(5)=(L1−L2)/Vp (sec)

(7) Image arrival difference−Sheet arrival difference=(3)−(6)=0

The transfer-to-transfer time is different for each pitch mode but the difference is equal to the difference in image arrival time, so the sheets always arrive at transfer at the appropriate time. This assumes that the offset distance is maintained and constant for all pitch modes.

Sheet sizes less than the maximum sheet size for their given pitch will have an additional stop time in the inverter. For cases where the seam zone is larger than the IDZ, those sheets whose duplex side is imaged immediately after the seam will have an additional stop time in the inverter.

The control of document and copy sheet handling systems in printers, including copiers, may be accomplished by conventionally actuating them by signals from the copier controller directly or indirectly in response to simple programmed commands and from selected actuation or non-actuation of conventional switch inputs by the operator, such as switches selecting the number of copies to be made in that run, selecting simplex or duplex copying, selecting whether the documents are simplex or duplex, selecting a copy sheet supply tray, etc. The resultant controller signals may, through conventional software programming, conventionally actuate various conventional electrical solenoid or cam-controlled sheet deflector fingers, motors and/or clutches in the selected steps or sequences as programmed. As is also well known in the art, conventional sheet path sensors or switches connected to the controller may be coordinated therewith and utilized for sensing timing and controlling the positions of the sheets in the reproduction apparatus, keeping track of their general positions, counting the number of completed document set copies.

Figure 4:
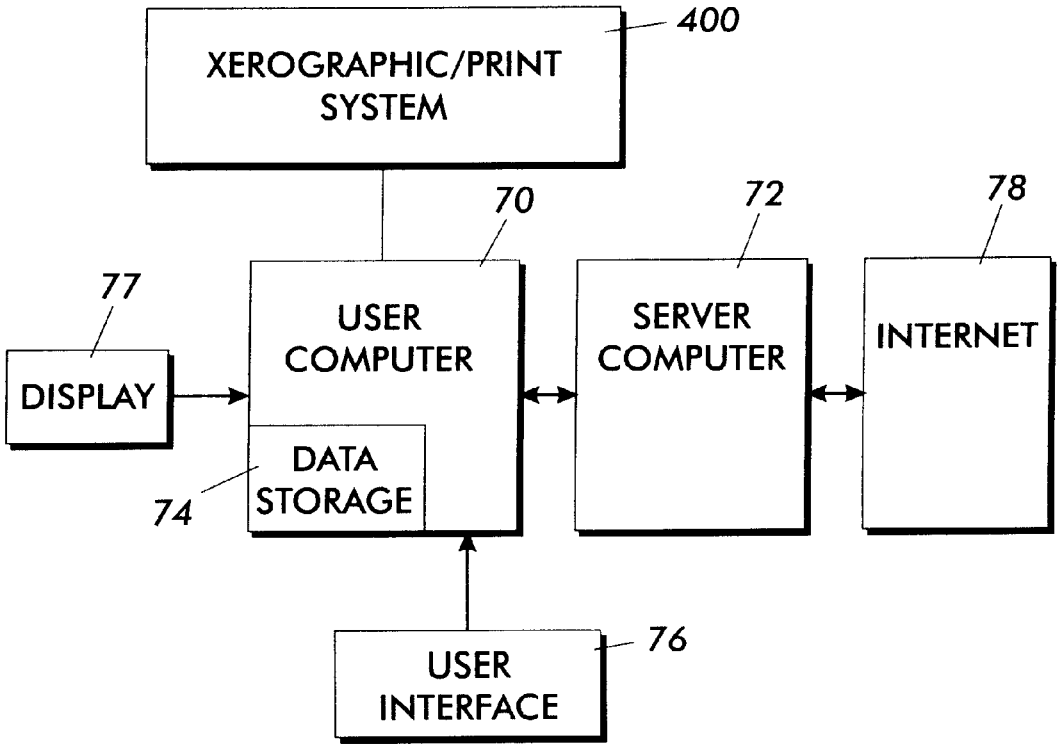
FIG. 4 is a block diagram of one embodiment of a typical apparatus incorporating features of the present invention that may be used to practice the present invention.

The present invention may also include software and computer programs incorporating the process steps and instructions described above that are executed in different computers. FIG. 4 is a block diagram of one embodiment of a typical apparatus incorporating features of the present invention that may be used to practice the present invention. As shown, a computer system 70 may be linked to another computer system 72, such that the computers 70 and 72 are capable of sending information to each other and receiving information from each other. In one embodiment, the xerographic or print system 400 could be coupled to the user computer 70. Alternatively, the computer systems and hardware illustrated in FIG. 4 could be integrated into the system 400. In one embodiment, computer system could include a server computer 72 adapted to communicate with the network. In the preferred embodiment, the computers are connected to a communication network. Computer systems 70 and 72 can be linked together in any conventional manner including a modem, hard wire connection, or fiber optic link. Generally, information can be made available to both computer systems 70 and 72 using a communication protocol typically sent over a communication channel 78 such as the Internet, or through a dial-up connection on ISDN line. Computers 70 and 72 are generally adapted to utilize program storage devices embodying machine readable program source code which is adapted to cause the computers 70 and 72 to perform the method steps of the present invention. The program storage devices incorporating features of the present invention may be devised, made and used as a component of a machine utilizing optics, magnetic properties and/or electronics to perform the procedures and methods of the present invention. In alternate embodiments, the program storage devices may include magnetic media such as a diskette or computer hard drive, which is readable and executable by a computer. In other alternate embodiments, the program storage devices could include optical disks, read-only-memory ("ROM") floppy disks and semiconductor materials and chips.

Computer systems 70 and 72 may also include a microprocessor for executing stored programs. Computer 70 may include a data storage device 74 on its program storage device for the storage of information and data. The computer program or software incorporating the processes and method steps incorporating features of the present invention may be stored in one or more computers 70 and 72 on an otherwise conventional program storage device. In one embodiment, computers 70 and 72 may include a user interface 76, and a display interface 77 from which features of the present invention can be accessed. The user interface 76 and the display interface 77 can be adapted to allow the input of queries and commands to the system 400, as well as present the results of the commands and queries.

In a tandem print engine with two photoreceptors 128 and 128*a,* the present invention enables constant inverter speed, but N can be a non-integer number. An offset can exist between the first and second photoreceptor seams. This offset enables the inverter speed and timing to be independent of the paper path length between transfer points. This increases the flexibility in choosing inverter speeds that meet the system timing constraints. The performance of the system is optimized with seamed photoreceptors and avoids changing the speed of the inverter, an option that potentially negatively impacts reliability, particularly in high speed tandem engines.

Having a constant inverter speed simplifies software and controls and reduces hardware costs. By offsetting the seams, we remove the interdependency between photoreceptor length and duplex path length. Inverter speeds can be selected based upon subsystem constraints, not overall system timing. The timing strategy can work for multiple markers or in cases where inverter modules are placed in the duplex path. The only adjustment that would have to be made would be a change in the offset of the seam following the inverter in order to compensate for the change in the path length.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A method of duplex imaging in a tandem print engine system comprising the steps of:

imaging a first side of a sheet in a first marking module in the system;

inverting the sheet; and imaging a second side of the sheet in a second marking module in the system one pitch after N revolutions of a photoreceptor following the first side imaging.

2. The method of claim 1 wherein N is not an integer and the non-integer portion of N is equivalent to an amount of offset between a seam on a first photoreceptor and a seam on a second photoreceptor.

3. The method of claim 1 wherein the offset enables the timing to be independent of the paper path length between transfer points.

4. The method of claim 1 wherein the inverter speed is chosen to meet crash timing and registration constraints.

5. The method of claim 1 wherein the step of inverting the sheet further includes the step of maintaining a constant inverter speed in the system, wherein a timing speed of the inverter is set so that a time between a simplex transfer and a duplex transfer is defined by (N revolutions+X)+1 pitch, wherein N is an integer and X is a real number.

6. The method of claim 1 wherein the step of inverting the sheet further comprises the steps of:

accelerating the sheet when a virtual trailing edge of the sheet passes from an output point in a paper path of the system into an inverter portion of the system; and reversing a direction of movement of the sheet when an original trailing edge of the sheet reaches a direction change point in the inverter.

7. A method of duplex imaging in a single print engine electrophotographic system comprising the steps of:

imaging a first side of a sheet;

inverting the sheet; and imaging a duplex side of the sheet one pitch after an integer number of revolutions of a photoreceptor in the system.

8. The method of claim 7 wherein a speed of an inverter in the system used to invert the sheet is constant for all pitch modes.

9. The method of claim 7 wherein a time between a start of a transfer of the simplex and the duplex images is equal to a time it takes for the photoreceptor to make one complete revolution and one pitch.

10. The method of claim 7 further comprising the step of maintaining a constant inverter speed during imaging, wherein the speed is set so that a time between a simplex transfer and a duplex transfer is defined by the equation N revolutions+1 pitch, wherein N is an integer.

11. The method of claim 7 wherein the step of inverting the sheet further comprises the steps of:

accelerating the sheet when a virtual trailing edge of the sheet passes from an output point in a paper path of the system into an inverter portion of the system; and reversing a direction of movement of the sheet when an original trailing edge of the sheet reaches a direction change point in the inverter.

12. An electrographic printing system comprising:

a tandem print engine system including a first photoreceptor and a second photoreceptor, the first and second photoreceptor each having a seam that are offset by an amount X relative to each other and each of the first and second photoreceptors are revolving at a constant speed;

wherein an imaging of a duplex side of a sheet occurs an (N+X) number of revolutions and one pitch after imaging of a simplex side of the sheet, wherein N is an integer number of revolutions of the first and second photoreceptor and X is any real number.

13. The system of claim 12 wherein a physical offset between the seam for the first photoreceptor and the seam for the second photoreceptor is X times a photoreceptor length, wherein the photoreceptor length is the same for the first photoreceptor and the second photoreceptor.

14. The system of claim 12 wherein the photoreceptor belt seams for the first photoreceptor and the second photoreceptor are offset by a constant distance.

15. The system of claim 14 wherein an optimal inverter speed is selected by adjusting the offset between the photoreceptor belt seams.

16. The system of claim 12 further comprising two photoreceptor belts, each photoreceptor belt having a seam, the seams being offset by an amount X, wherein an inverter speed timing is set so that a time between a simplex transfer and a duplex transfer is defined by the formula (N+X) revolutions+1 pitch, wherein N is an integer and X is any real number.

17. The system of claim 16 wherein each photoreceptor has a same length and a physical offset between the photoreceptor seams is defined by (X*Photoreceptor length).

18. A computer program product comprising:

a computer useable medium having computer readable code means embodied therein for causing a computer to perform duplex imaging in a tandem print engine system, the computer readable code means in the computer program product comprising:

computer readable program code means for causing a computer to image a first side of a sheet in a first marking module in the system;

computer readable program code means for causing a computer to invert the sheet;

computer readable program code means for causing a computer to image a second side of the sheet in a second marking module in the system one pitch after N revolutions of a photoreceptor following the first side imaging.

19. The computer program product of claim 18 further comprising computer readable program code means for causing a computer to inverting the sheet by maintaining a constant inverter speed in the system and setting a timing speed of the inverter so that a time between a simplex transfer and a duplex transfer is defined by (N revolutions+X)+1 pitch, wherein N is an integer and X is a real number.

* * * * *